US006409133B1

(12) United States Patent
Billan

(10) Patent No.: US 6,409,133 B1
(45) Date of Patent: Jun. 25, 2002

(54) CURTAIN SUPPORTING DEVICE

(76) Inventor: Jean-Francois Billan, 26, rue lebour, Paris (FR)

( * ) Notice: Subject to any disclaimer, the term of this patent is extended or adjusted under 35 U.S.C. 154(b) by 0 days.

(21) Appl. No.: 09/147,252

(22) Filed: Nov. 12, 1998

(30) Foreign Application Priority Data

May 13, 1996 (FR) ..... 96 05894

(51) Int. Cl.[7] ..... A47H 1/10
(52) U.S. Cl. ..... 248/261; 248/259; 160/343
(58) Field of Search ..... 248/261, 214, 248/215, 259, 298.1; 16/108, 87.2; 160/330, 343

(56) References Cited

U.S. PATENT DOCUMENTS

| | | | | |
|---|---|---|---|---|
| 559,716 A | * | 5/1896 | Kerr | 160/330 X |
| 1,954,941 A | * | 4/1934 | Monnier | 160/330 X |
| 4,832,104 A | * | 5/1989 | De Labarthe et al. | 160/343 |
| 6,056,035 A | * | 5/2000 | Laster-Bivens | 160/330 X |

FOREIGN PATENT DOCUMENTS

| | | |
|---|---|---|
| CH | 185888 | 8/1936 |
| CH | 238488 | 7/1945 |
| FR | 811764 | 4/1937 |
| GB | 2167649 | 6/1986 |

* cited by examiner

*Primary Examiner*—Leslie A. Braun
*Assistant Examiner*—A. Joseph Wujciak
(74) *Attorney, Agent, or Firm*—Greenblum & Bernstein, P.L.C.

(57) ABSTRACT

A device for supporting a curtain including a hollow rail which includes a length, a narrowed opening, and an upper attachment surface for attaching the rail to a horizontal support surface. A helically wound spring is disposed inside the hollow rail and includes a plurality of turns, a fixed end, and a moveable end. A plurality of curtain holding members are disposed on the plurality of turns wherein the plurality of holding members can move within the narrowed opening. The hollow rail is attachable via the upper attachment surface to the horizontal support surface so as to support a curtain along the length of the hollow rail.

11 Claims, 2 Drawing Sheets

CURTAIN SUPPORTING DEVICE

CROSS REFERENCE TO RELATED APPLICATIONS

The present application is a File Wrapper Continuation of application number 09/147,252 filed Nov. 12, 1998, which is a U.S. National Stage under 35 U.S.C. 371 of PCT/FR97/00821, filed May 7, 1997, not published under PCT Article 21(2) in English. The present application also claims priority under 35 U.S.C. § 119 of French Patent Application No. 96 05894 filed on May 13, 1996.

BACKGROUND OF THE INVENTION

1. Field of the Invention

The present invention relates to a curtain supporting device.

In the current state of the art, two methods are used to hang curtains.

2. Description of Background and Related Information

The first method consists in using a horizontal rod on which are strung rings attached to the curtain. This method is generally applied to small-sized curtains, such as those used in households, since it does not lend itself to the motor-driven opening and closing.

The second method consists in using a horizontal rail for guiding carriages under each of which the curtain is attached.

By exerting a horizontal traction on the lead carriage the curtain is pulled along and, in the case of an opening maneuver, the portion of the latter between the first and the second carriage is unfolded. In continuing this action, the portion between the second and third carriage is unfolded, and so on.

From the aforementioned explanation, it appears that when a curtain is opened, it forms identical folds, but these disappear one after another during the closing of the curtain. This phenomenon is reversed during the opening.

When applied to a stage curtain, it turns out therefore that the visual effect is not pleasant during an opening or a closing.

Added to this is the fact that carriages are expensive, fragile and always cumbersome mechanical assemblies.

SUMMARY OF THE INVENTION

The present invention, which overcomes these drawbacks, is noteworthy in that the curtain is hung beneath a spring, helically wound and suitably guided by a support member by way of holding members set at every n turn.

The spring is affixed at one of its ends and can be subject to a traction at the other by way of a usual cable.

When an action is exerted on the cable, the spring bends, which means that the distance separating two adjoining turns will increase or decrease by a certain k value, and that the distance separating two holding members will vary in the quantity n.k. The result thereof is that the curtain folds will form or disappear uniformly.

Such a visual effect could not be obtained using the known devices.

BRIEF DESCRIPTION OF THE DRAWINGS

The present invention will be better understood in the following description, with reference to the attached drawings, given only by way of example, in which.

DETAILED DESCRIPTION OF THE INVENTION

Figure 1:
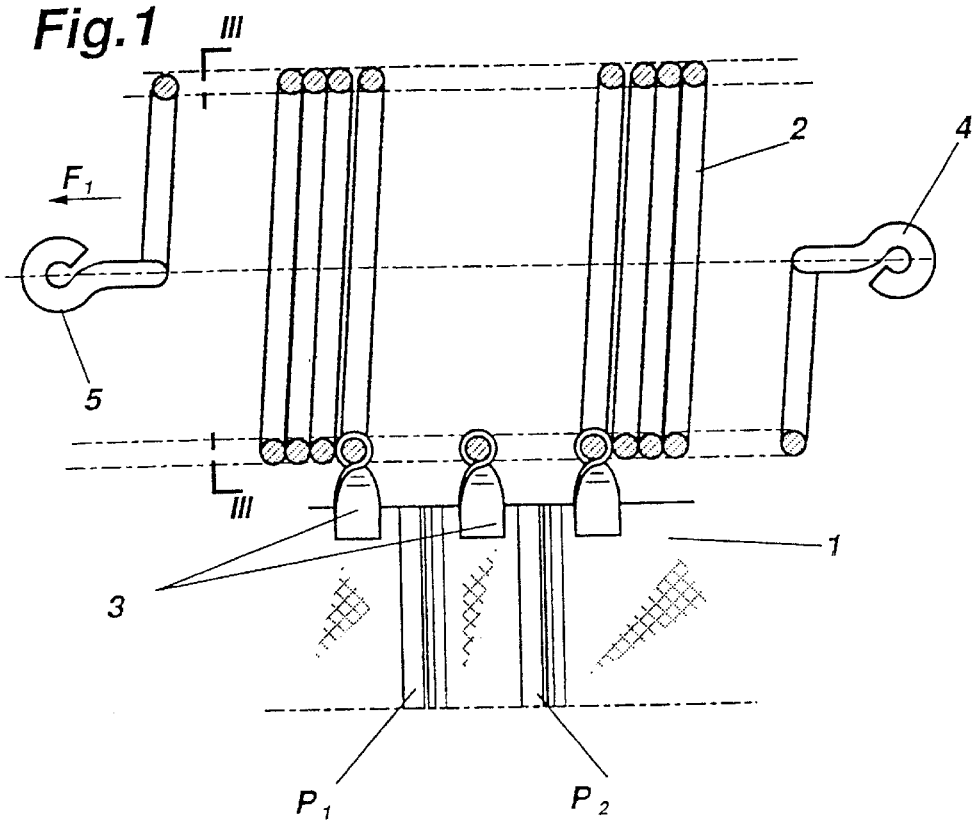
FIG. 1 is a schematic view of the device of the invention, the curtain being shown the open position.

In reference to the drawings, the curtain 1 is hung under a support member constituted by a spring 2, helically wound, by way of holding members, such as those designated by the reference numeral 3, for example.

In the example shown, each holding member 3 is constituted by a tongue straddling certain turns and attached to the upper edge of the curtain.

The holding members are set at every n turn, the value of the number n depending on the total width of the curtain and the number of holding members.

According to one embodiment, the spring 2 is a spring with contiguous turns. Therefore, if the end 4 is fixed and if a traction is exerted on the end 5 in the direction of the arrow $F_1$, the spring will be stretched, and the distance separating the adjoining members 3 will increase, which means that the widths of the curtain folds $P_1$ and $P_2$ will increase while remaining equal.

In releasing the action on the end 5, the spring will be released and the opposite phenomenon will occur. The effect of the spring release can be combined with a traction on the end 5 in the opposite direction of the arrow $F_1$.

Figure 2:
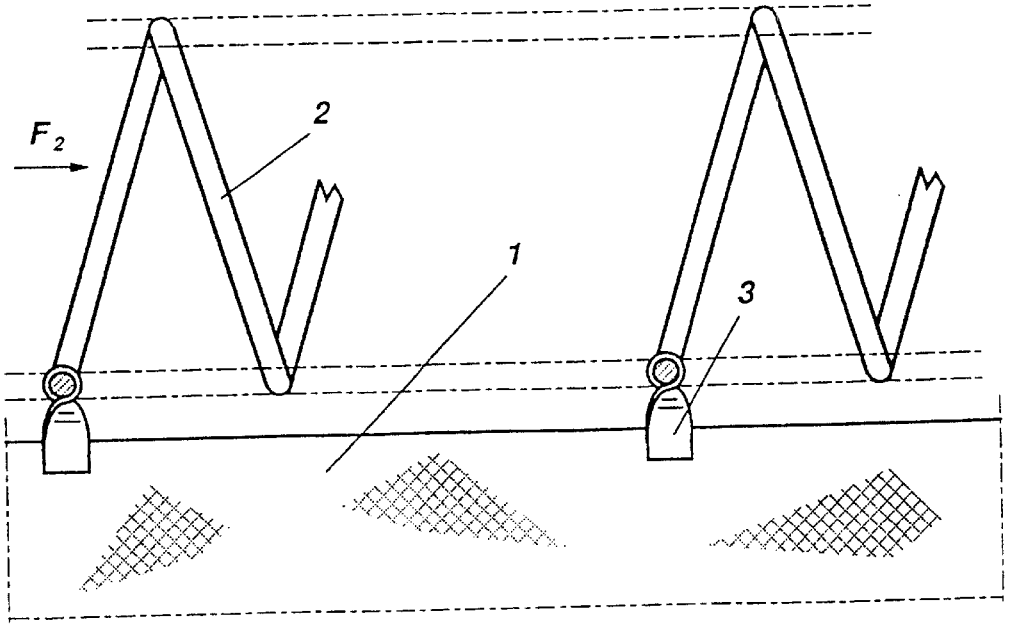
FIG. 2 is a view similar to FIG. 1, the curtain being shown in the closed position.
Figure 3:
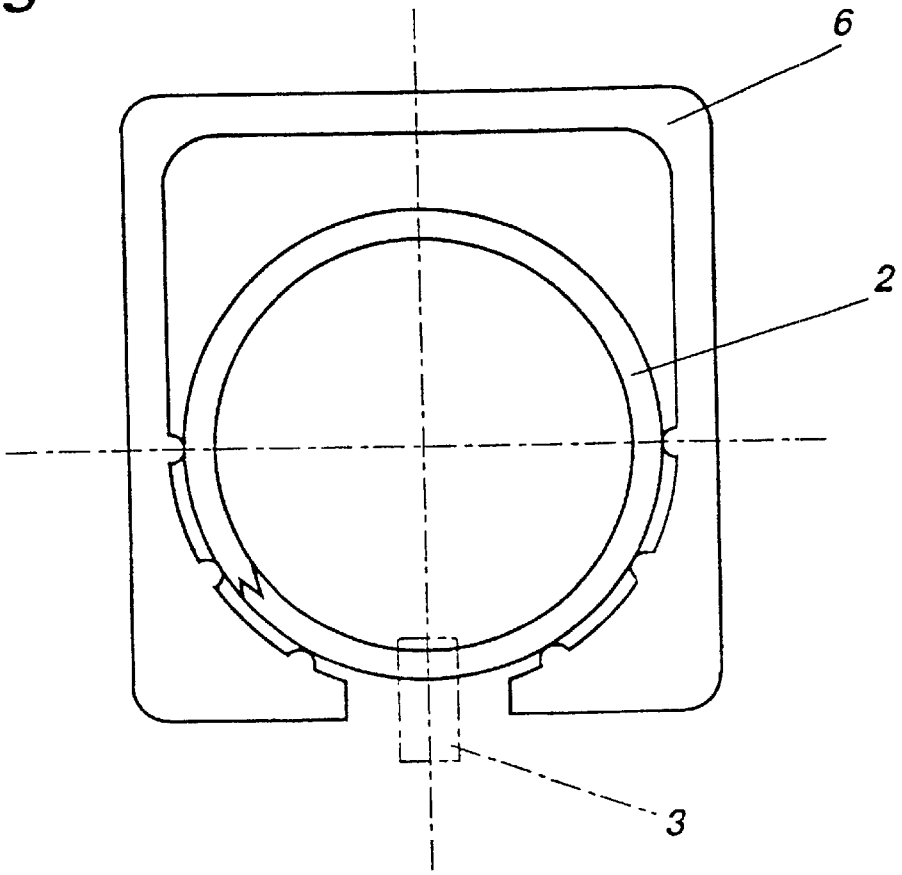
FIG. 3 is a cross-sectional view along the line III—III of FIG. 1.
Figure 4:
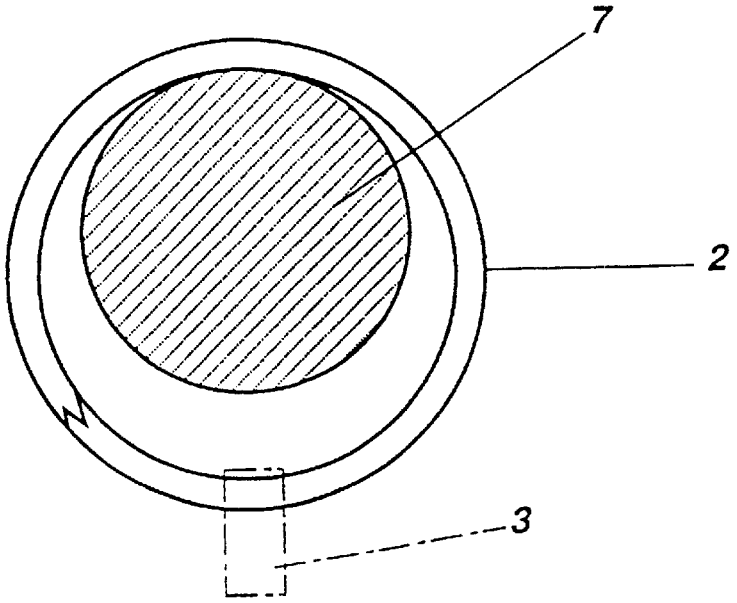
FIG. 4 is a view similar to FIG. 3, showing another embodiment.

FIG. 2 shows another embodiment according to which the spring is a spring with noncontiguous turns. In this case and in the absence of action on the spring, the curtain is normally closed. To open the curtain, a traction must be exerted on the free end of the spring along the arrow $F_2$.

According to one or the other of the embodiments, the spring 2 is guided in a horizontal rail 6, taking on, in cross section, the form of an inverted U with a narrowed opening. This rail can be straight or curved.

According to an alternative embodiment, the spring 2 can be guided on a rod 7 that extends through it.

It must be noted that, contrary to the known devices, the device according to the invention allows unfolding or folding several curtains or streamers.

It must also be noted that by fixing one of the turns with respect to the guiding member 6–7, it is possible to exert a traction on one or the other of the ends of the spring and thus to unfold or fold only a part of the curtain, either to the left or to the right.

Without leaving the scope of the invention, it is possible, in view of obtaining certain stage effects, that the value of the number n will vary. This value can vary, for example, in a cyclic way, to take on the values $n_1$, $n_2$, $n_1$, $n_2$, etc.

What is claimed is:

1. A device for supporting a curtain comprising:

a U-shaped hollow rail comprising a length, a narrowed opening, and an upper straight surface;

a helically wound spring disposed inside the hollow rail and comprising a plurality of turns, a fixed end, and a moveable end;

a plurality of spring engaging projections disposed within the hollow rail for supporting the spring; and a plurality of curtain holding members disposed on the plurality of turns wherein the plurality of holding members can move within the narrowed opening, wherein the hollow rail supports the spring and the spring is adapted to support the curtain along the length of the hollow rail, the curtain being adapted to be supported only by the spring via the plurality of curtain holding members.

2. The device of claim 1, further comprising a rod disposed within the spring.

3. The device of claim 1, wherein the spring comprises one of contiguous and non-contiguous turns.

4. A device for supporting a curtain comprising:

a hollow U-shaped rail comprising a length, a narrowed opening which extends along the length, and a straight upper surface;

a helically wound spring disposed inside the hollow rail and comprising a plurality of turns, a fixed end, and a moveable end;

a plurality of spring supporting projections disposed within the hollow rail; and a plurality of curtain holding members disposed on the plurality of turns wherein the plurality of holding members can move within the narrowed opening, wherein the hollow rail supports the spring and the spring is adapted to support the curtain along the length of the hollow rail, the curtain being adapted to be supported only by the spring via the plurality of curtain holding members.

5. The device of claim 4, further comprising a rod disposed within the spring.

6. The device of claim 4, wherein the spring comprises one of contiguous and non-contiguous turns.

7. A device for supporting a curtain comprising:

a hollow U-shaped rail comprising a length, a narrowed opening which extends along the length, and a straight upper surface;

a helically wound spring disposed inside the hollow rail and comprising a plurality of turns;

a plurality of spring supporting projections disposed inside the rail, the projections supporting the spring away from an inside surface of the hollow rail;

a plurality of curtain holding members disposed on the plurality of turns wherein the plurality of holding members can move within the narrowed opening; and a curtain, wherein the hollow rail supports the curtain along the length of the hollow rail, and wherein the curtain is supported only by the spring via the plurality of curtain holding members.

8. The device of claim 7, further comprising a rod disposed within the spring.

9. The device of claim 7, wherein the spring comprises one of contiguous and non-contiguous turns.

10. The device of claim 7, wherein the spring comprises a fixed end and a moveable end.

11. The device of claim 7, wherein the hollow rail supports the curtain along the entire length of the rail.

* * * * *